US010668526B2

(12) United States Patent
Pezzoli

(10) Patent No.: US 10,668,526 B2
(45) Date of Patent: Jun. 2, 2020

(54) DIE-CASTING MACHINE WITH A VALVE DIAGNOSIS SYSTEM

(71) Applicant: ITALPRESSE INDUSTRIE S.P.A., Brescia (IT)

(72) Inventor: Andrea Pezzoli, Brescia (IT)

(73) Assignee: ITALPRESSE INDUSTRIE S.P.A., Brescia (IT)

( * ) Notice: Subject to any disclaimer, the term of this patent is extended or adjusted under 35 U.S.C. 154(b) by 0 days.

(21) Appl. No.: 16/484,447

(22) PCT Filed: Feb. 8, 2018

(86) PCT No.: PCT/IB2018/050787
§ 371 (c)(1),
(2) Date: Aug. 7, 2019

(87) PCT Pub. No.: WO2018/146615
PCT Pub. Date: Aug. 16, 2018

(65) Prior Publication Data

US 2020/0030875 A1 Jan. 30, 2020

(30) Foreign Application Priority Data

Feb. 10, 2017 (IT) ..... 10201700014874

(51) Int. Cl.
*B22D 17/32* (2006.01)
*B22D 17/20* (2006.01)
*B22D 17/22* (2006.01)
*F15B 19/00* (2006.01)

(52) U.S. Cl.
CPC ..... *B22D 17/32* (2013.01); *B22D 17/203* (2013.01); *B22D 17/2281* (2013.01); *F15B 19/005* (2013.01)

(58) Field of Classification Search
CPC ..... B22D 17/203; B22D 17/32; B29C 45/76
See application file for complete search history.

(56) References Cited

U.S. PATENT DOCUMENTS

2003/0080452 A1* 5/2003 Bulgrin ..... B29C 45/76 264/40.1
2007/0299706 A1* 12/2007 Galt ..... B22D 17/32 705/7.11
2011/0054828 A1 3/2011 Junk
(Continued)

FOREIGN PATENT DOCUMENTS

EP 2942127 A1 11/2015
WO WO 2016/046326 A1 3/2016

OTHER PUBLICATIONS

International Search Report and Written Opinion, dated May 8, 2018, for the corresponding International Application No. PCT/IB2018/050787 in 9 pages.

*Primary Examiner* — Kevin E Yoon
(74) *Attorney, Agent, or Firm* — Polsinelli PC

(57) ABSTRACT

An injection assembly (1) of a die-casting machine is provided with electronic control means (300) of the valves, configured and programmed for carrying out a plurality of diagnostic tests on said valves. The test management program provides for the execution of a test for each valve and the comparison of parameters detected during said test with a predefined interval or with a threshold value. Furthermore, means are provided for displaying the results of the diagnostic tests.

8 Claims, 20 Drawing Sheets

(56) References Cited

U.S. PATENT DOCUMENTS

| | | | | |
|---|---|---|---|---|
| 2011/0247777 | A1* | 10/2011 | Hauser | B22D 17/32<br>164/303 |
| 2016/0200022 | A1* | 7/2016 | Takei | B29C 45/77<br>264/328.1 |

* cited by examiner

TEST 2

TEST 3

TEST 9

TEST 11

DIE-CASTING MACHINE WITH A VALVE DIAGNOSIS SYSTEM

The present invention relates to a hydraulically operated die-casting machine, in particular for the die-casting of light alloys. In particular, the present invention relates to an injection assembly of the machine, equipped with valves for managing the injection process, provided with a self-diagnosis system for the operation of said valves.

As is known, such machines operate on a mold, consisting of two half-molds coupling to form the cavity corresponding to the piece to be made, and consisting of a closing assembly of the mold and an injection assembly, provided with an injection piston to pressurize the molten metal poured into the mold.

For the actuation of the injection piston and for further process management tasks, a hydraulic circuit is provided which is regulated by numerous valves. The performance of such valves is of crucial importance for the proper operation of the machine, and a malfunction will cause the machine to stop or the quality level of the molded parts to be drastically reduced.

The time to recover operation is often long, with the imaginable repercussions on the system's productivity.

The object of the present invention is to provide a hydraulically operated die-casting machine equipped with a system for diagnosing the valves which overcomes the aforementioned drawbacks.

Such object is achieved by a die-casting machine made according to claim 1. The dependent claims define further embodiments of the invention.

The features and advantages of the die-casting machine according to the present invention will be clear from the description given below, provided by way of non-limiting example, in accordance with the appended figures, wherein.

Figure 1:
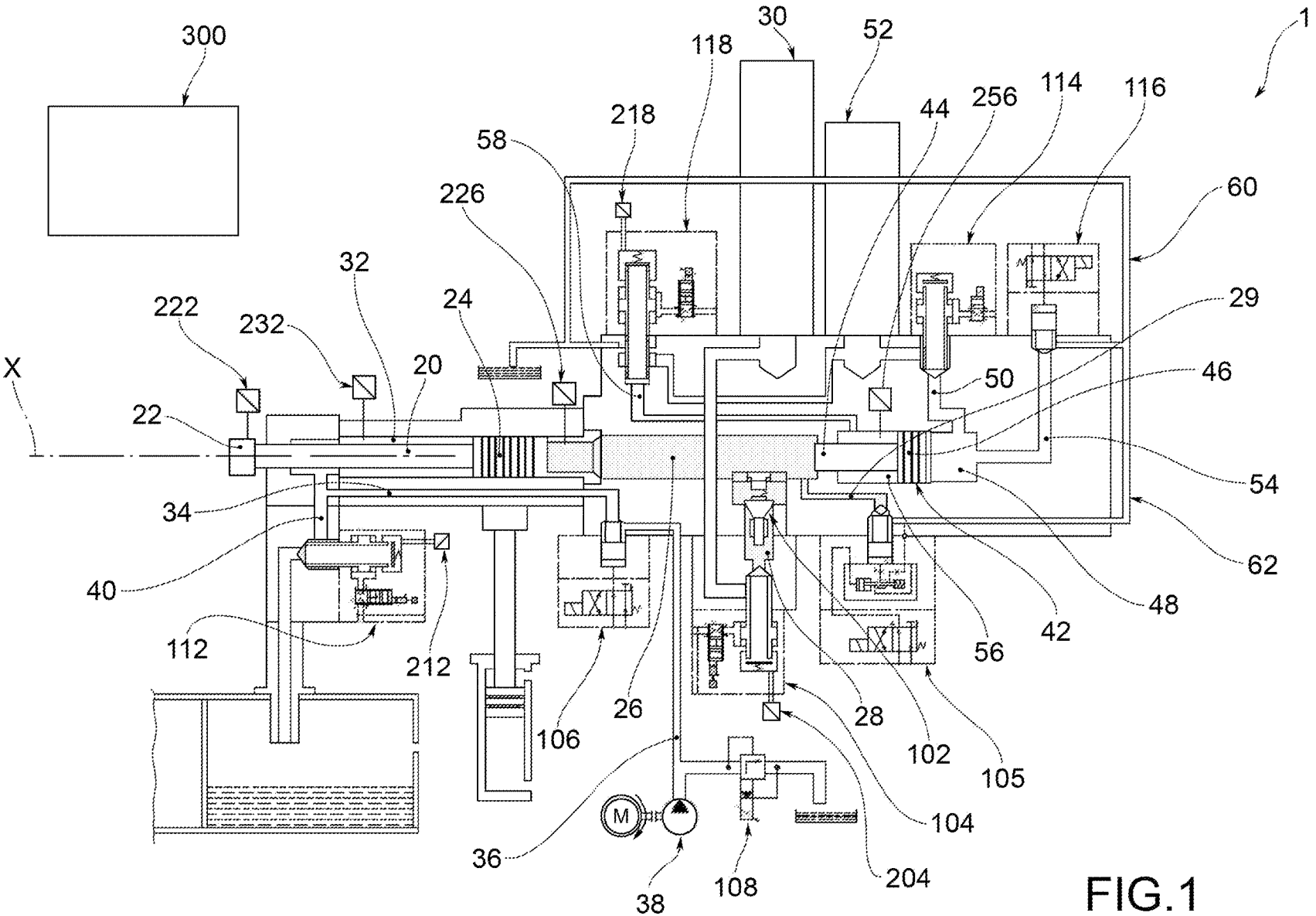
FIG. 1 shows a functional diagram of an injection assembly of a die-casting machine, equipped with valves for managing the process, according to an embodiment of the present invention.

With reference to FIG. 1, an injection assembly of a hydraulically operated die-casting machine is indicated collectively at 1.

The injection assembly 1 comprises an injection piston 20 which extends along a translation axis X between a head end 22 and an opposing tail end 24. The injection piston 20 is translatable on command along said translation axis X by means of a hydraulic drive.

The injection assembly 1 also has a main pressure chamber 26, upstream of the injection piston 20, i.e. upstream of the tail end 24 thereof, for containing and pressurizing the fluid intended for the outward translation of the injection piston 20.

Furthermore, the injection assembly 1 comprises a main fluid inlet 28 and a shut-off valve 102 located between the main inlet 28 and the main chamber 26 and suitable to prevent the return of fluid from the main chamber 26 to the main inlet 28.

For example, said shut-off valve 102 is made in accordance with the teaching contained in document EP-A1-2942127 in the name of the Applicant.

The machine further comprises a first accumulator 30 (which may be loaded from a relative cylinder, for example containing pressurized nitrogen) for movement circuit of the injection piston 20. Said first accumulator 30 is connected upstream of the main inlet 28, and between said accumulator 30 and said main inlet 28 a proportional feed valve 104 operates.

Said feed valve 104 is electronically controlled and uses feedback due a position transducer 204 suitable to detect a signal as a function of the valve opening.

The main pressure chamber 26 is further connected to an injection drain 29 connected to drain, along which an injection return drain valve 105 is operative.

The injection assembly 1 further comprises a main back-pressure chamber 32, downstream of the tail end 24 of the injection piston 20, connected to a return inlet 34 for supplying pressurized fluid for the return translation of the injection piston 20.

The return inlet 34 is connected upstream with a pump feed 36, upstream of which a pump 38 is located, typically actuated by an electric motor.

An injection return valve 106 is arranged between the pump feed 36 and the return inlet 34.

Moreover, a proportional maximum pump pressure valve 108 is arranged in parallel on the pump feed 36 and connected to the drain for regulating the pressure exiting the pump 38.

In addition, the main back-presssure chamber 32 is connected to a return drain 40 connected to drain, along which is arranged a proportional injection drain valve 112, which is electronically controlled and provided with a position transducer 212 suitable to emit a signal as a function of the opening of said valve.

Furthermore, the injection assembly 1 comprises pressure multiplier means suitable to increase the pressure of the fluid contained in the main chamber 26 above the pressure supplied by the accumulator 30.

Said multiplier means comprise a multiplier piston 42 which extends along a multiplication axis Y, for example coinciding with the translation axis X of the injection piston 20, between a head end 44, suitable to operate in compression in the main chamber 30, and an opposite tail end 46.

The multiplier piston 42 is translatable on command along the multiplication axis Y.

The pressure multiplier means further comprise a secondary pressure chamber 48, upstream of the multiplier piston 42, and a secondary fluid inlet 50, upstream of the secondary chamber 100, for the input of pressurized fluid.

The machine further comprises a second accumulator 52 (with the related cylinder for recharging) which is connectable to the secondary inlet 50, and a multiplier release valve 114 is placed between the second accumulator 52 and the secondary inlet 50.

The secondary pressure chamber 48 is also connected to a multiplier return drain 54 connected to drain, along which is arranged a multiplier return drain valve 116.

Furthermore, the multiplier means comprise a secondary back-presssure chamber 56 downstream of the tail end 46 of the multiplier piston 42, connectable to the second accumulator 52 via a secondary return inlet 58.

Along said secondary return inlet 58, between the second accumulator 52 and the secondary back-presssure chamber 56, an electronically controllable proportional main multiplier valve 118 is operative and provided with a position transducer 218 suitable to emit a signal as a function of the opening of the valve.

Finally, a first auxiliary portion 60 connects the multiplier return drain valve 116 to the main multiplier valve 118 and releases the pressure, and a second portion 62 connects the multiplier return drain valve 116 to the injection return drain valve 105.

Furthermore, the injection assembly 1 comprises
an injection piston position sensor 220, for example an encoder, for detecting the position of the injection piston 20;
a main back-presssure chamber pressure transducer 232, to detect the pressure in the main back-presssure chamber 32;
a main pressure chamber pressure transducer 226, to detect the pressure in the main pressure chamber 26;
a secondary back-presssure chamber pressure transducer 256, to detect the pressure in the secondary back-presssure chamber 56.

The die-casting method comprises a first injection step, wherein the injection piston 20 advances at a reduced speed, to allow the molten metal to fill the accessory channels provided in the mold.

For the first injection step, for a controlled partial opening of the feed valve 104, the pressurized fluid is fed to the main inlet 28, for example at a nominal pressure of 150 bar, and from this to the main chamber 30 as a result of opening the main shut-off valve 102.

By means of the controlled opening of the injection drain valve 112, the main back-presssure chamber 32 releases the pressure so that the action of the fluid in the main pressure chamber 30 and the opposite action of the fluid in the main back-presssure chamber 32 generate an outward thrust on the injection piston 20, at the desired speed.

Subsequently, preferably without interruption from the previous step, the method provides for a second injection step, wherein the injection piston 20 advances at a higher speed than the forward speed of the first step.

For the second injection step, for further controlled opening of the feed valve 104, for example total, the pressurized fluid is fed to the main inlet 28 at a greater flow rate and from this to the main pressure chamber 30 as a result of opening the main shut-off valve 102.

Moreover, preferably, for the further controlled opening of the injection drain valve 112, the main back-presssure chamber 32 releases the pressure so that the action of the fluid in the main chamber 30 and the opposite action of the fluid in the main back-presssure chamber 32 generate an outward thrust on the injection piston 20, at the high speed desired.

Later still, preferably without interruption from the previous step, the method provides for a third injection step, wherein the injection piston acts at almost zero speed, but exerts on the molten metal an elevated thrust, to force the molten metal, now in solidification, to offset the shrinkage suffered by cooling.

For the third injection step, the pressure multiplier means are activated.

In particular, the pressurized fluid is fed to the secondary inlet 50 and from there to the secondary pressure chamber 48 following the controlled opening of the multiplier release valve 114. The secondary back-presssure chamber 56 is fed with pressurized fluid in a controlled manner through the main multiplier valve 118, so that the multiplier piston 42 exerts a thrust action on the fluid present in the main pressure chamber 30, increasing the pressure thereof, for example up to 500 bar.

As a result, the shut-off valve 102, sensitive to the pressure difference between the main inlet 40 and the main pressure chamber 30, passes into the closed configuration, fluidically separating the main input 40 and the main pressure chamber 30.

The fluid in the main pressure chamber 30, brought to a higher pressure, then operates on the injection piston 20, so that said piston exerts on the metal in the mold the desired action to offset the shrinkage.

After completing the third injection step, the multiplier means are deactivated; in particular, the multiplier piston 42 performs a return stroke by virtue of the pressurized fluid fed to the secondary back-presssure chamber 56 and the connection to the drain of the secondary pressure chamber 48 due to the opening of the multiplier return drain valve 116.

In addition, the injection piston 20 completes a return stroke due to the pressurized fluid fed to the main back-presssure chamber 32 through the return inlet 34 and the pump feed 36 by opening the injection return valve 106, and the connection to the drain of the main pressure chamber 30 by opening the injection return drain valve 105.

The machine further comprises management means 300, comprising for example an electronic control unit i.e. a programmable PLC or a microprocessor, operatively connected with said valves and/or with said sensors and/or transducers, for controlling the opening and closing of said valves, as a function of the signals emitted by said sensors and/or said transducers and/or as a function of a predetermined management program.

According to the invention, the machine is provided with a diagnostic system which allows the correct operation of the aforesaid valves to be verified by performing a test on each valve, comparing parameters detected during said test with a predefined interval or with a threshold value, set by the operator or detected during a basic test.

In other words, a test is performed on each valve, in sequence one at a time, and the parameters detected during said test are compared with a predefined interval or with a threshold value.

Moreover, before performing a test, part of the hydraulic circuit is excluded from the oil supply, so that there are optimal conditions for checking the predefined valve on which the test is performed.

Moreover, said diagnostic system comprises display means, for example a monitor or a display, to display the result of each test, highlighting the correct operation, incorrect operation or the impossibility of performing the test.

Before performing each test, the diagnostic system verifies that such test may be performed, for example according to the type of valves the machine is equipped with, and, if it may be performed, performs such test.

Test 1: Feed Valve Offset Value

The purpose of the test, to be run on each feed valve, is to identify the control voltage value corresponding to the minimum opening of the valve, verifying that it is within the predefined range and that it does not change over time.

For the above-described machine, in particular, said test is performed for the feed valve 104 and any other proportional feed valves, inserted in parallel on the hydraulic circuit to the feed valve 104 and having the same function thereof, for example to satisfy the flow demand to the feed.

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);

6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 2:
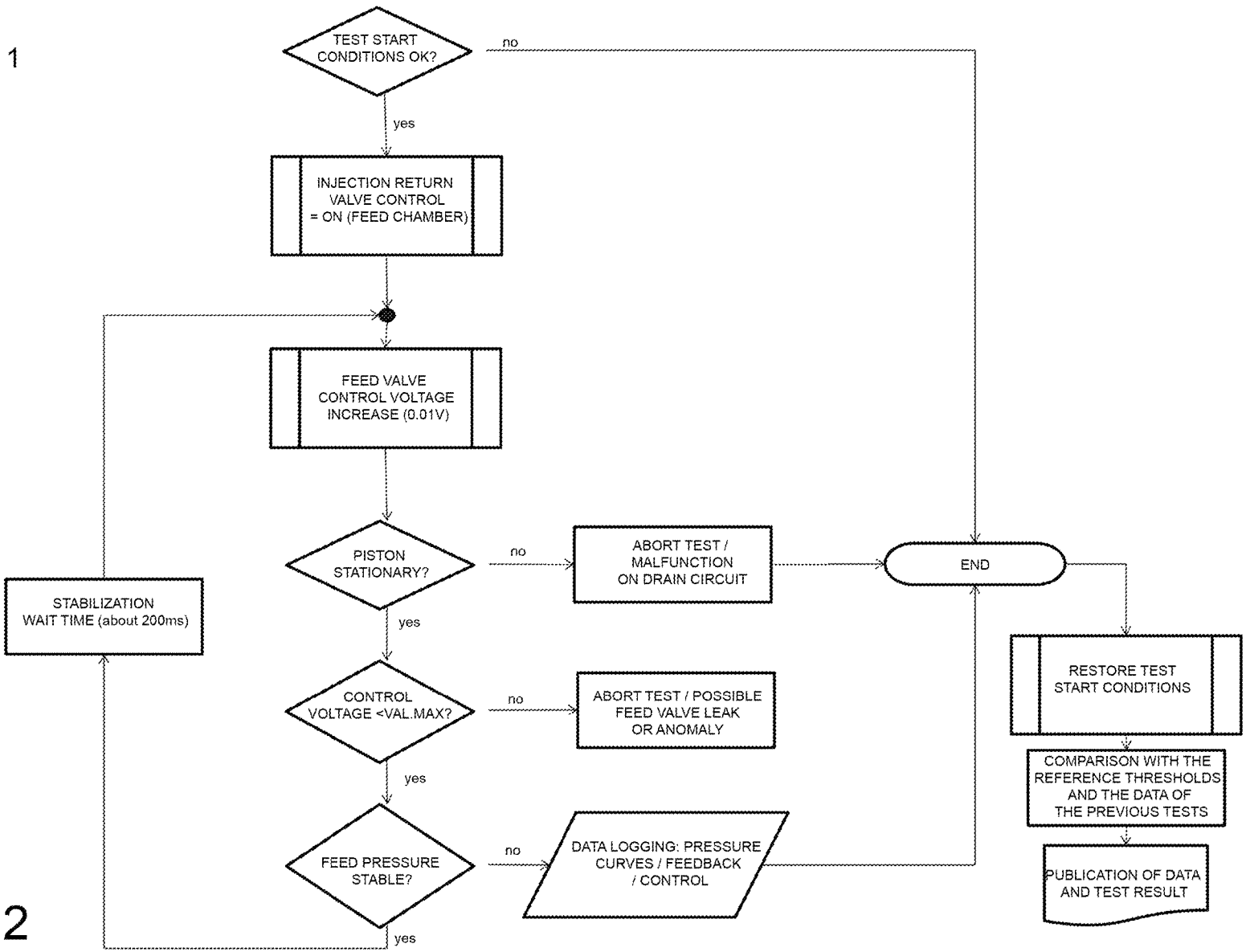
FIGS. 2 to 12 show flowcharts for the execution of tests on said valves of the injection assembly; some flowcharts are represented in two figures (for example, the diagram of Test 2 is shown in FIGS. 3*a* and 3*b*).

The test is performed according to the flowchart of FIG. 2.

Test 2: Drain Valve Offset Value

The purpose of the test, to be performed for each drain valve, is to identify the voltage control value corresponding to the minimum opening of the valve, verifying that it is within the predefined range and that it does not change over time.

For the above-described machine, in particular, said test is performed for the injection drain valve 112 and any other proportional drain valves, inserted in parallel on the hydraulic circuit to the drain valve 112 and having the same function thereof, provided, for example, to satisfy the flow requirement to the drain.

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 3A:
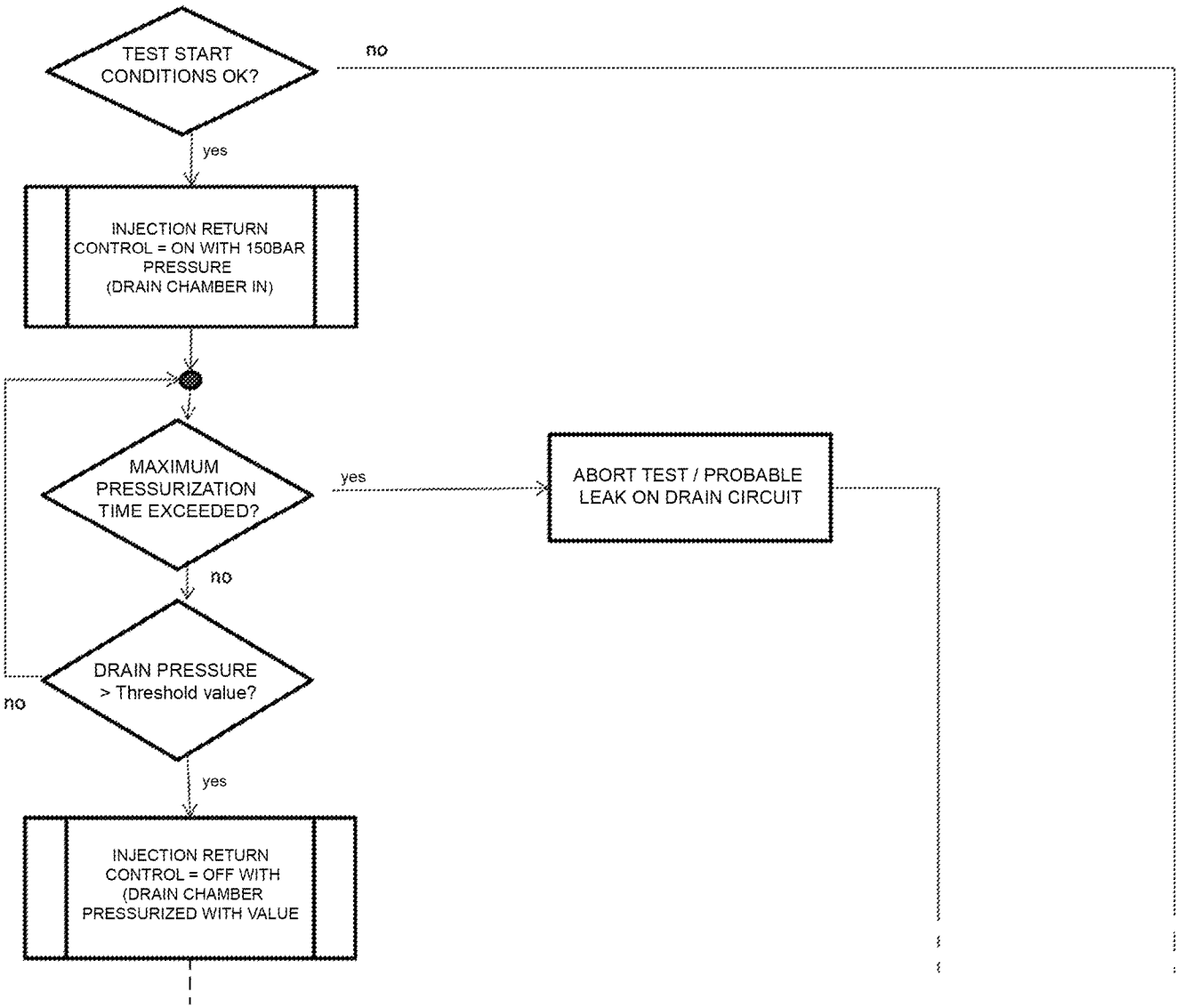
Figure 3B:
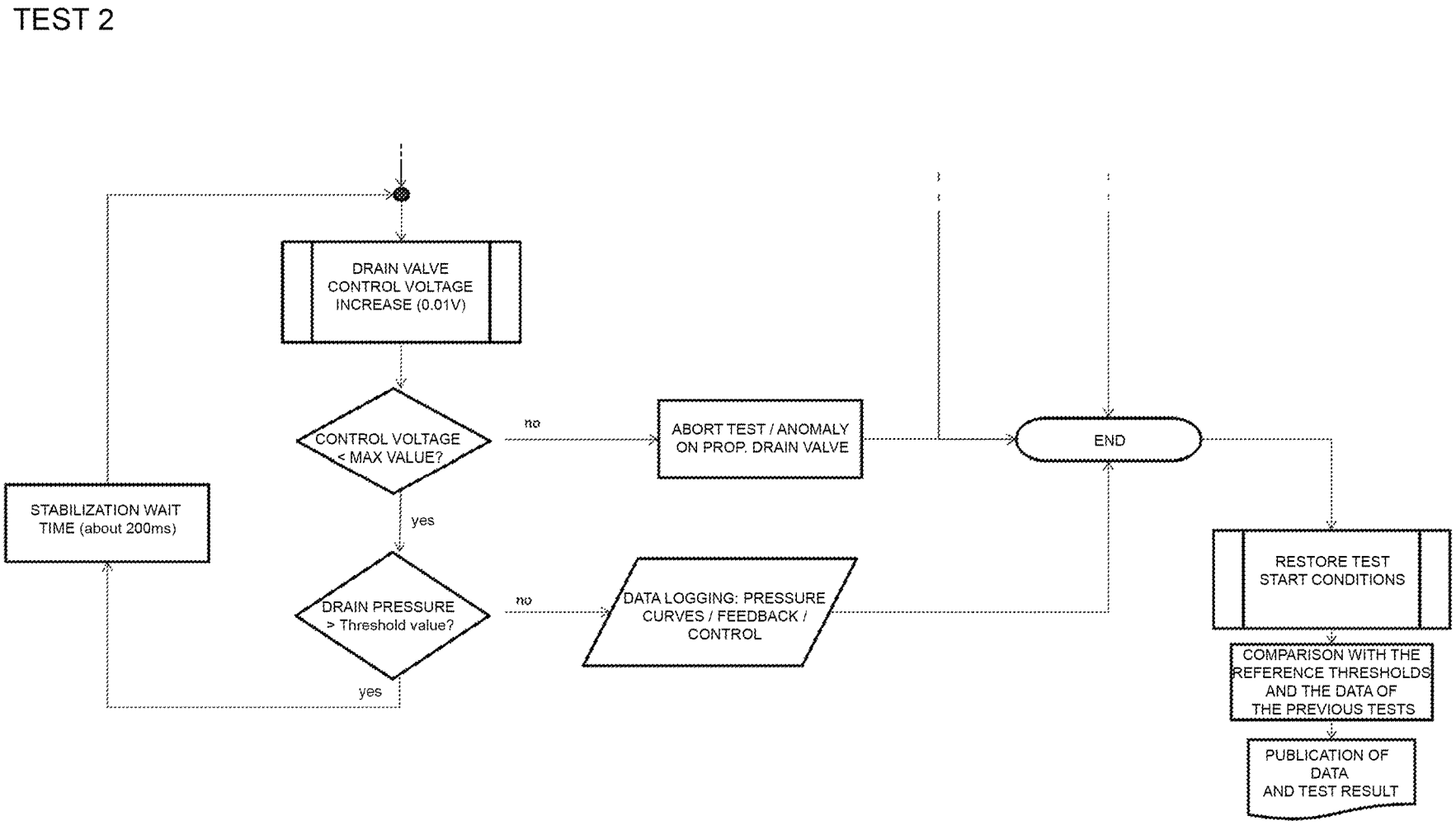

The test is performed according to the flowchart of FIG. 3.

Test 3: Opening and Closing Time of the Feed Valves

The purpose of the test is to verify the minimum opening and closing times of the feed valves (and therefore of the opening and closing speed) and is available for the feedback valves.

For the described machine, the test is performed for the feed valve 104 and for any other proportional feed valves inserted in parallel on the hydraulic circuit.

The test is carried out with the injection piston stationary, i.e. the test is carried out according to a control logic such that the piston in proper operating conditions does not move.

Furthermore, the accumulator 30 is discharged to not have pressurized oil following the opening of the valve, while the accumulator 52 is charged to ensure proper operation.

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 4A:
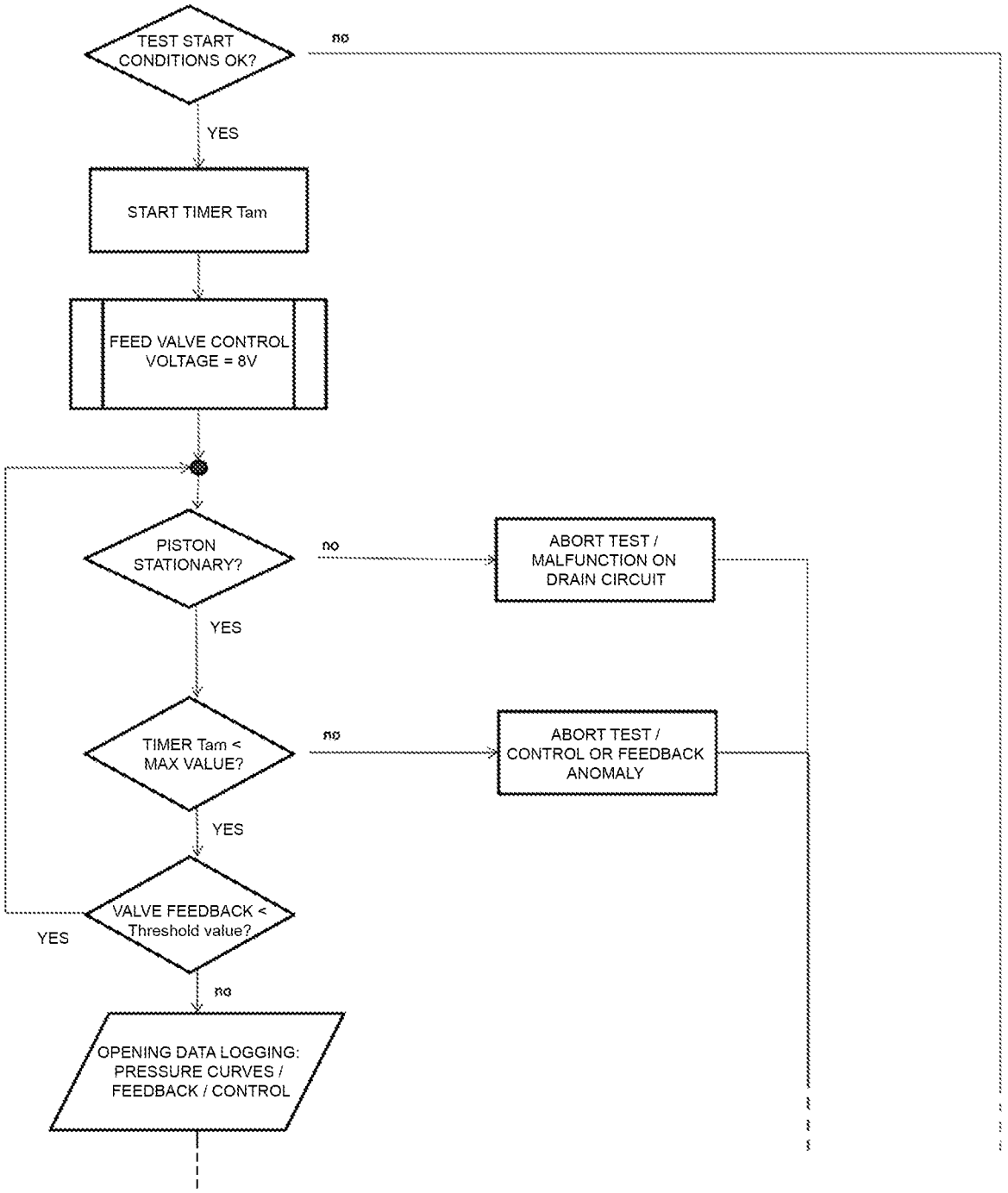
Figure 4B:
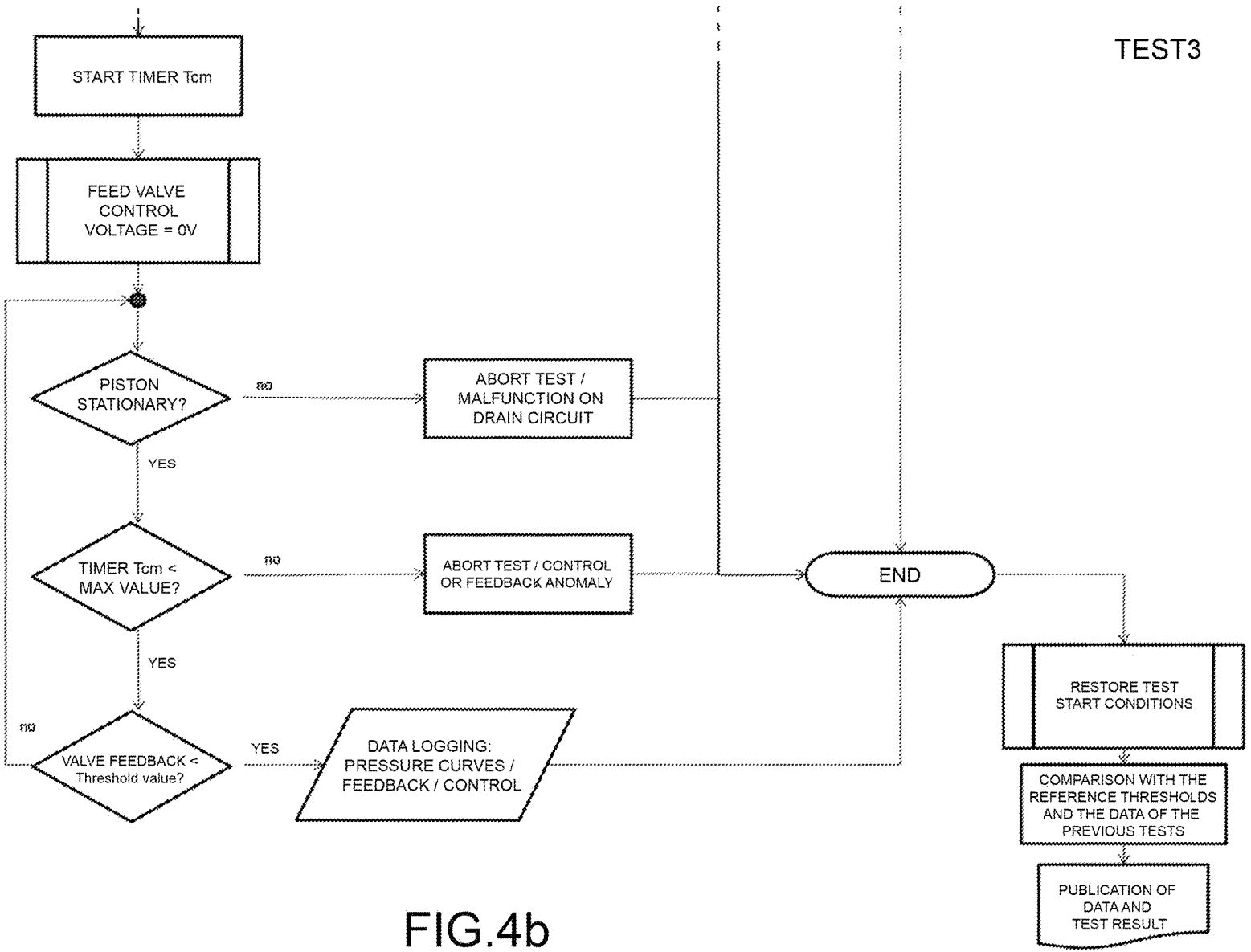

The test is performed according to the flowchart of FIG. 4, wherein
Tam=timer for measuring feed valve opening time;
Tcm=timer for measuring feed valve closing time.

Test 4: Opening and Closing Time of the Drain Valve

The purpose of the test is to verify the minimum opening and closing times of the drain valves (and therefore of the opening and closing speed) and is available for the feedback valves.

For the above-described machine, in particular, said test is performed for the drain valve 112 and any other proportional drain valves, inserted in parallel thereof and having the same function.

The test is performed with the injection piston stationary; moreover, the accumulator 30 is drained in order not to have pressurized oil following the opening of the valve, while the accumulator 52 is filled to ensure proper operation.

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained)
9) injection return valve uncontrolled;
10) multiplier return drain valve off (head side chamber drained);
11) feed pressure<threshold value (indicating no pressure);
12) piston in the retracted position;
13) injection safety access ports closed.

Figure 5A:
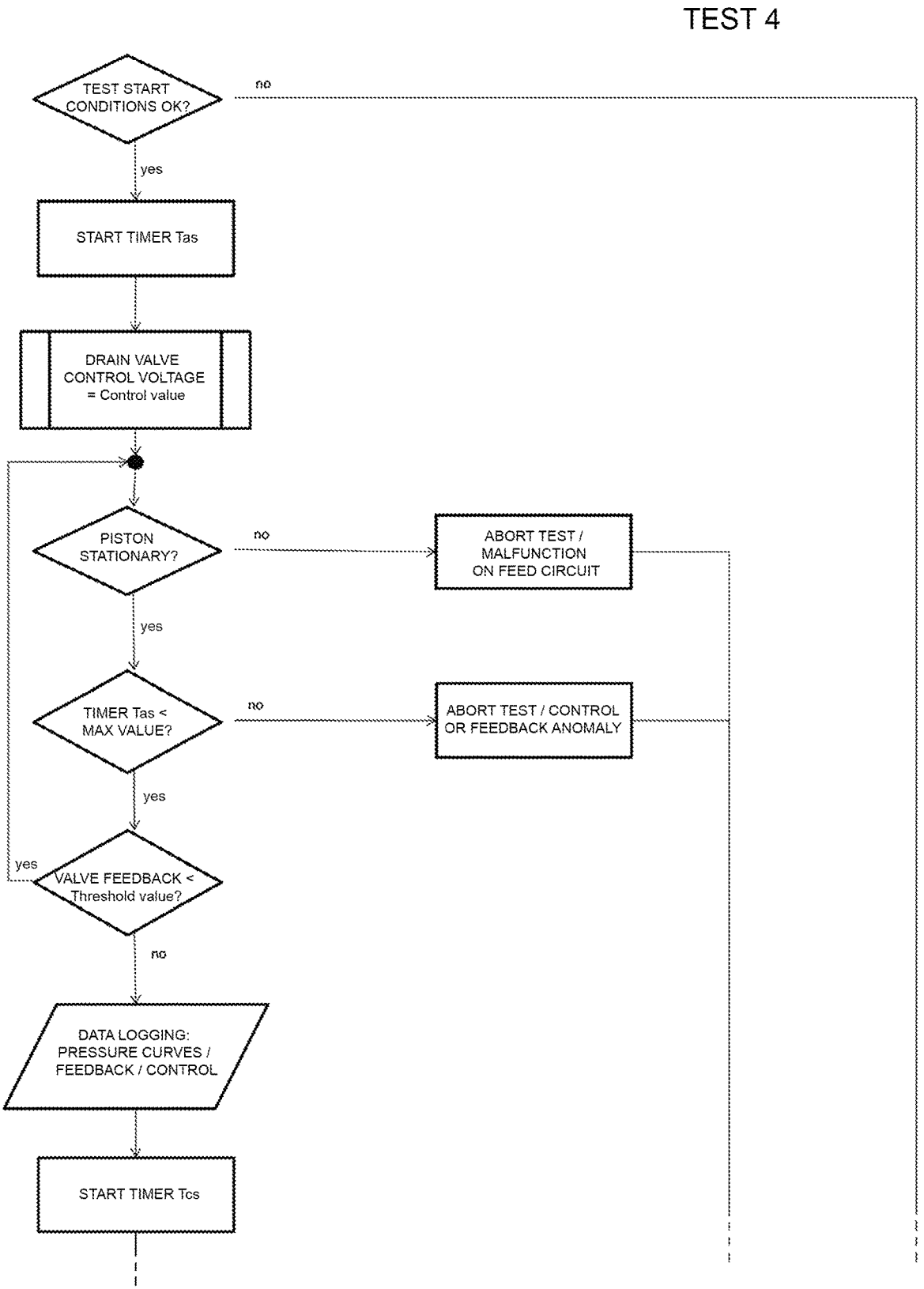
Figure 5B:
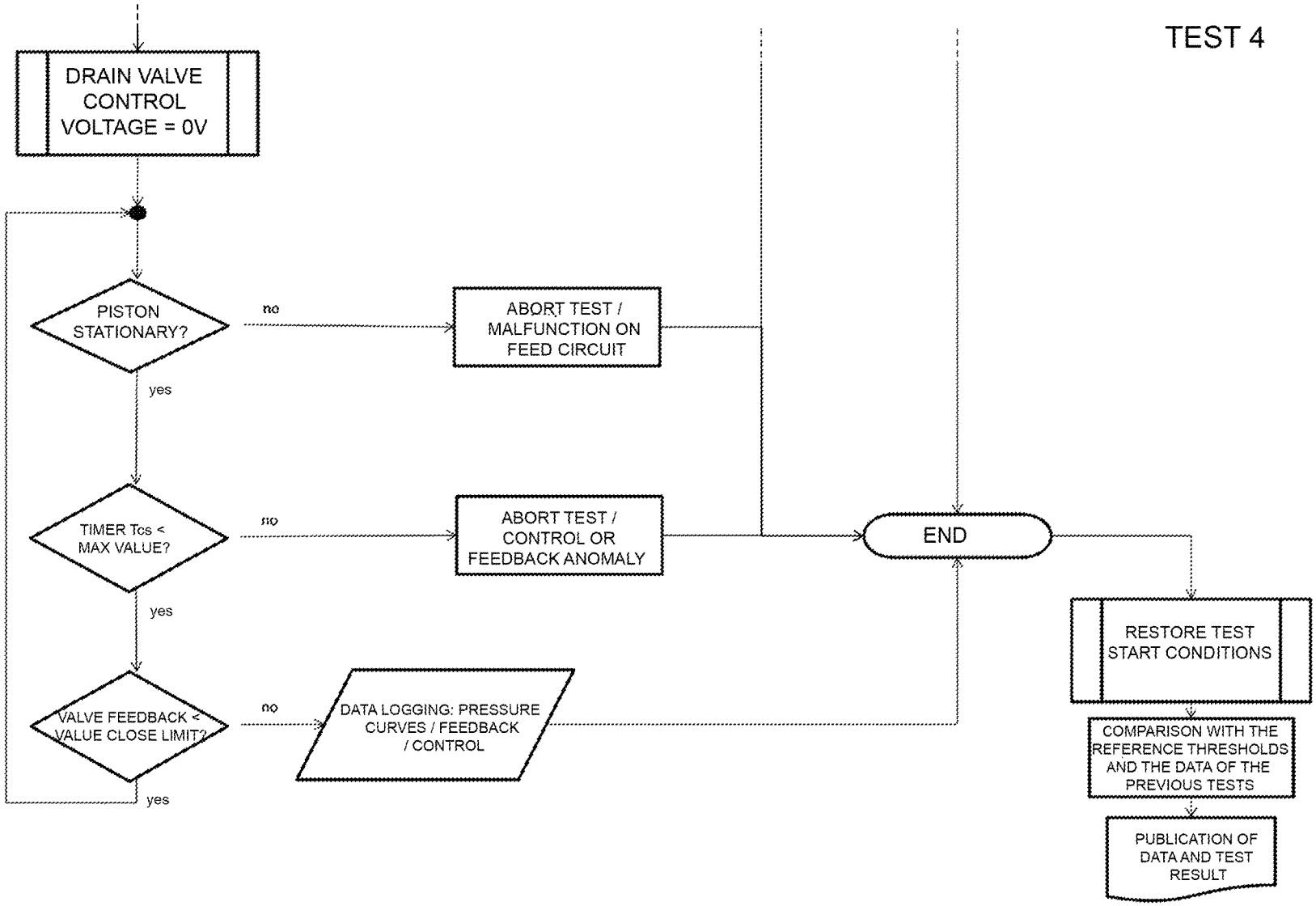

The test is performed according to the flowchart of FIG. 5, wherein
Tas=drain valve opening time
Tcs=drain valve closing time.

Test 5: Feed Valve Feedback

The purpose of the test is to verify the accuracy between control and response of the valve (feedback) and is available for valves with feedback measurement.

For the above-described machine, in particular, the test is performed for the feed valve 104 and any other proportional feed valves, inserted in parallel thereof and having the same function.

The test is performed with a stationary injection piston.

The test start conditions are as follows:

1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 6:
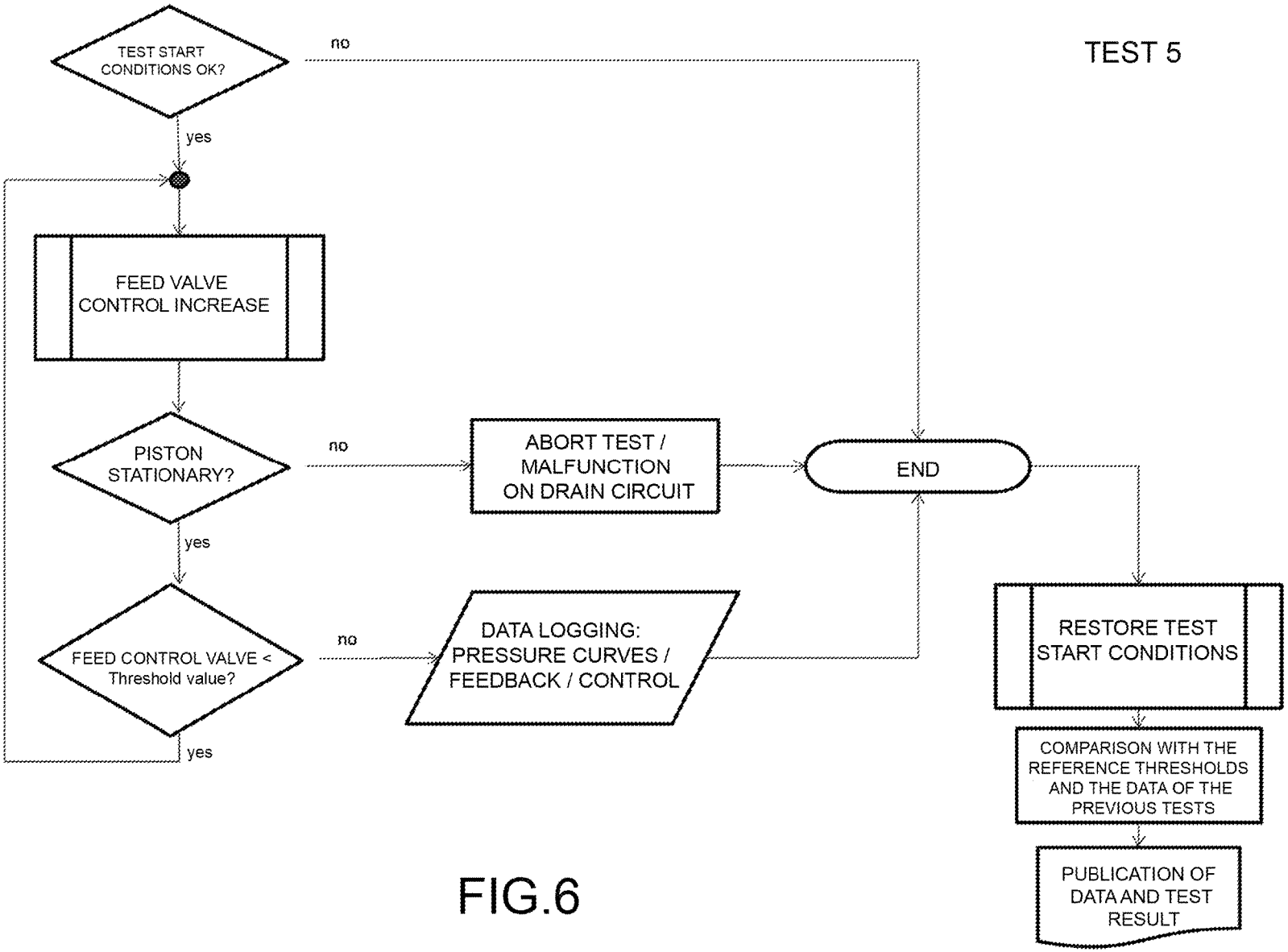

The test is performed according to the flowchart of FIG. 6.

Test 6: Drain Valve Feedback

The purpose of the test is to verify the accuracy between control and response of the valve (feedback) and is available for feedback valves.

For the described machine, in particular, the test is performed for the drain valve 112 and any other proportional drain valves, inserted in parallel on the hydraulic circuit to the drain valve 112 and having the same function thereof.

The test is performed with a stationary injection piston.

The test start conditions are as follows:

1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 7:
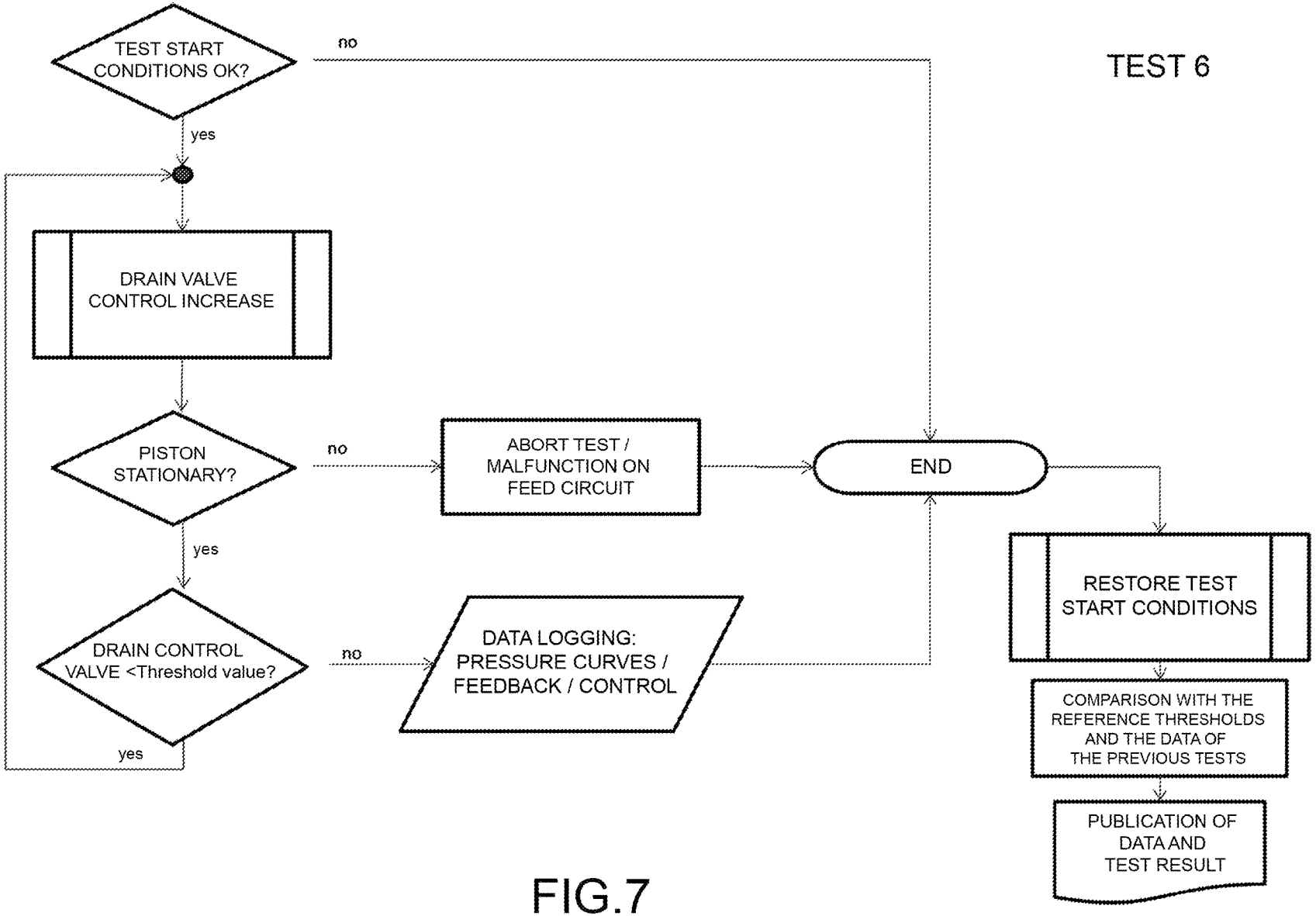

The test is performed according to the flowchart of FIG. 7.

Test 7: Feed Valve Hydraulic Leakage

The purpose of the test is to verify that the feed valves have no leakage.

For the above-described machine, in particular, the test is performed for the feed valve 104 and any other proportional feed valves, inserted in parallel on the hydraulic circuit to the feed valve 104 and having the same function thereof.

Preferably, the test is also performed for the injection return drain valve 105.

The test is divided into two steps:

1) the feed chamber is pressurized, and it is verified that the pressure remains stable (thus any leaks in the return drain valve are excluded);
2) the pressure is discharged, and the drain valve is closed and checked that the pressure does not rise (thus excluding possible leakages in the feed valve).

The test start conditions are as follows:

1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 8A:
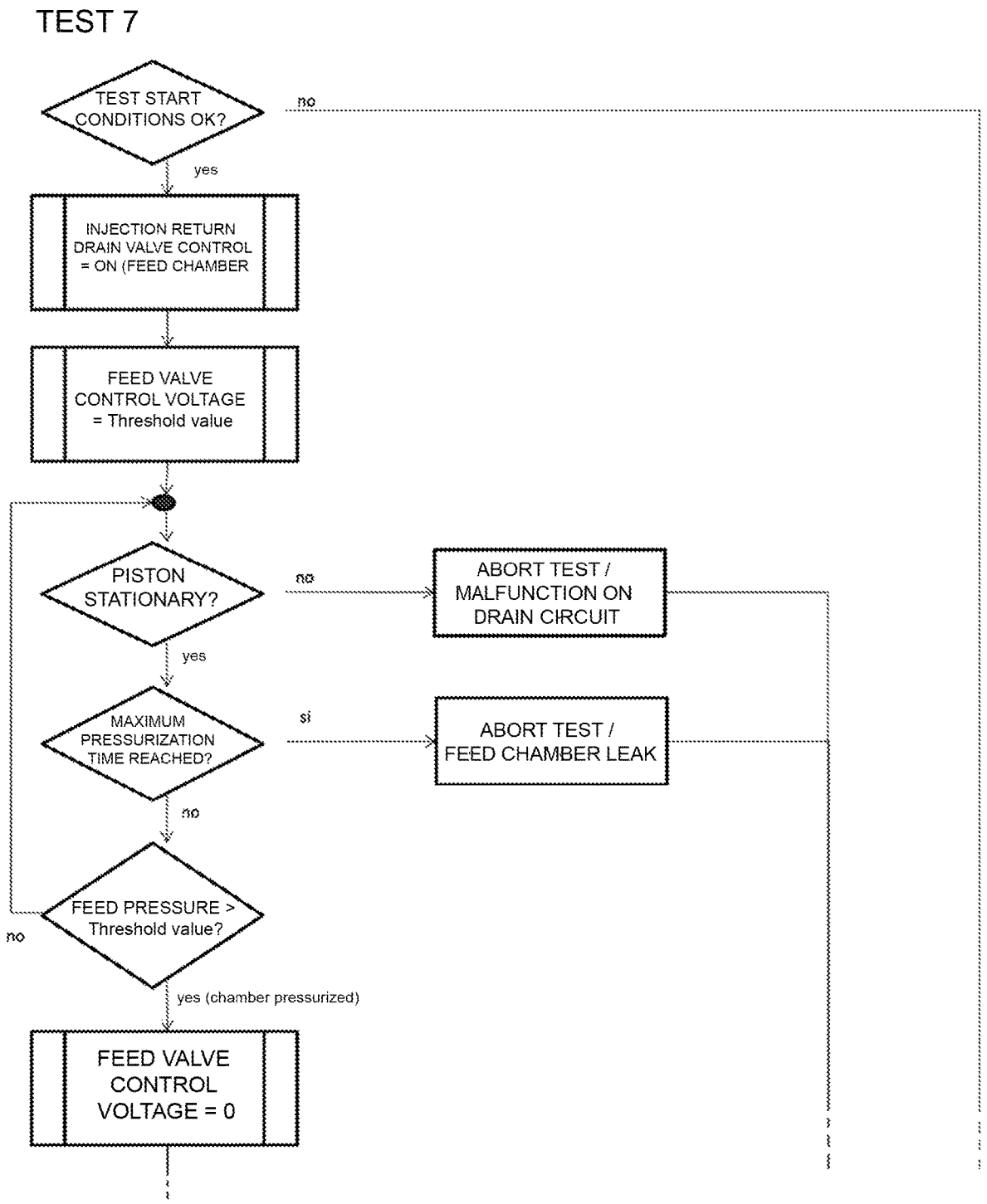
Figure 8B:
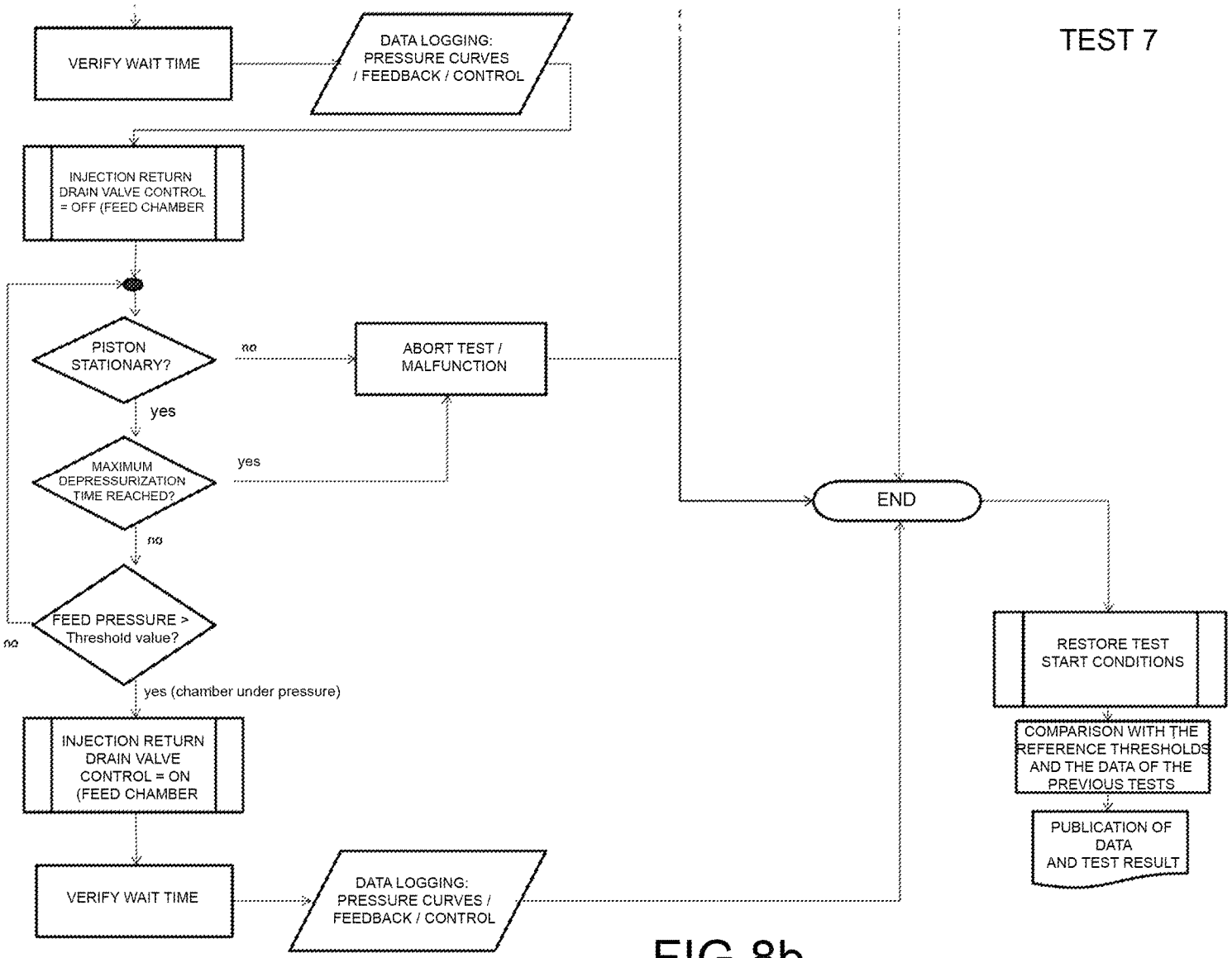

The test is performed according to the flowchart of FIG. 8.

Test 8: Drain Valve Hydraulic Leakage

The purpose of the test is to verify that the drain valve (injection cylinder rod side) has no leakage.

For the described machine, in particular, the test is performed on the drain valve 112 and any other proportional drain valves, inserted in parallel on the hydraulic circuit to the drain valve 112 and having the same function thereof.

Preferably, the test is also performed on the injection return valve 106.

The test is divided into two steps:

1) the drain chamber is pressurized, and it is verified that the pressure remains stable (thus excluding possible leaks in the injection drain valve 112);
2) the pressure is discharged, and the proportional drain valve is closed and checked that the pressure does not rise (thus excluding leaks in the injection return valve).

The test start conditions are as follows:

1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;

10) multiplier return drain valve off (head side chamber drained);
11) feed pressure<threshold value (indicating no pressure);
12) piston in the retracted position;
13) injection safety access ports closed.

Figure 9A:
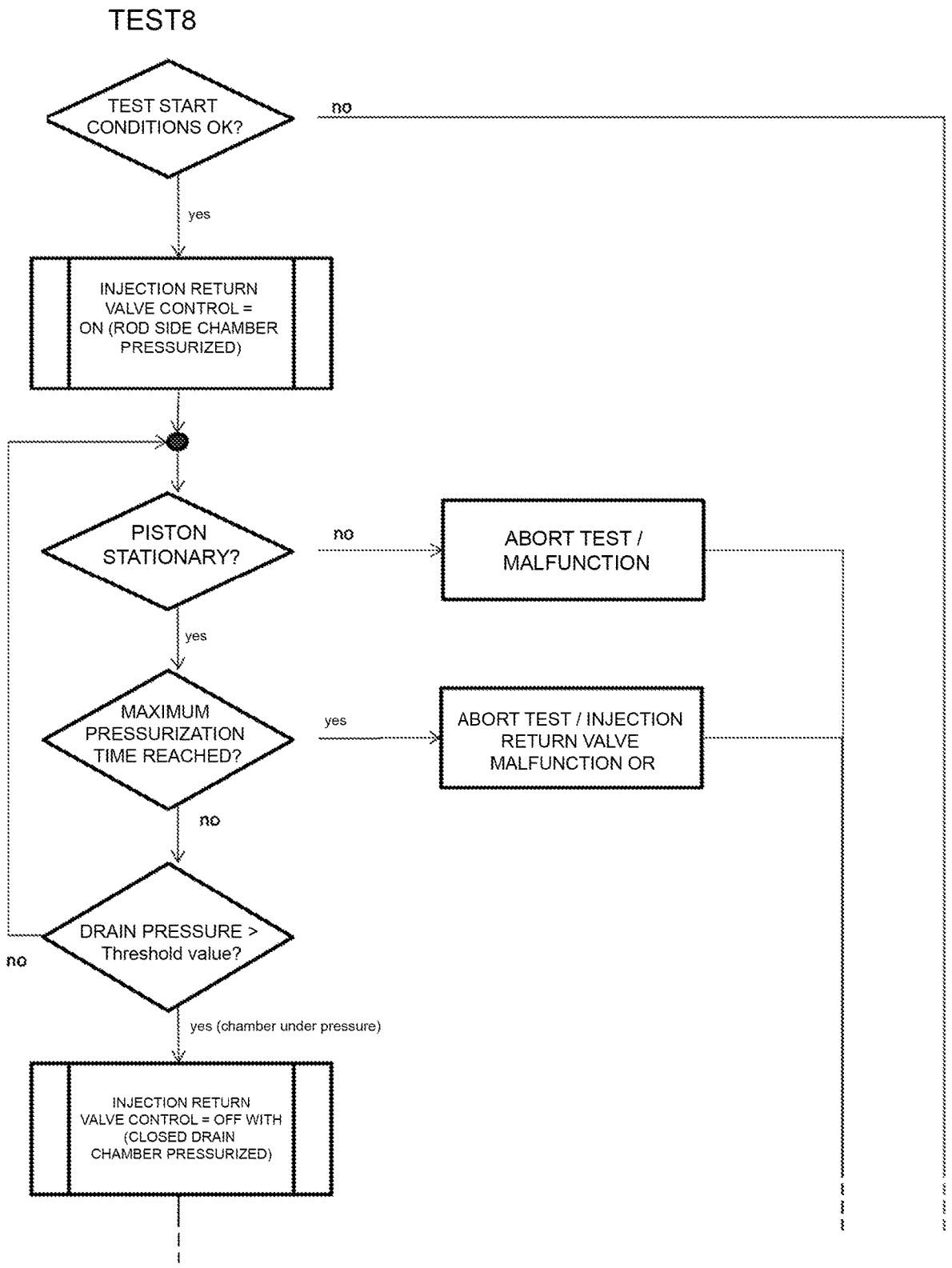
Figure 9B:
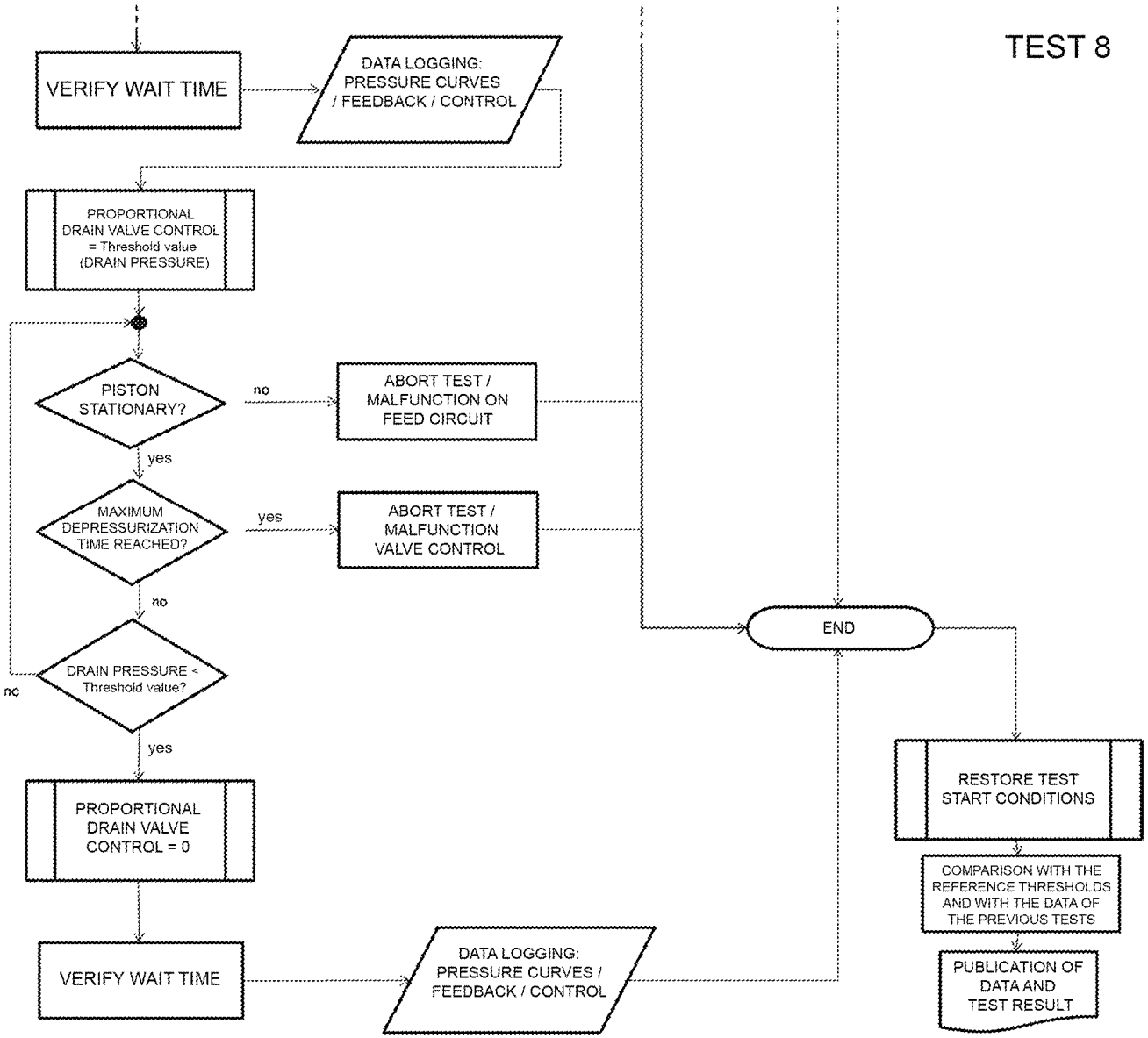

The test is performed according to the flowchart of FIG. 9.

Test 9: Opening and Operation of the Multiplier Release Valve (Closed Loop Injections)

The purpose of the test is to verify that the multiplier release valve opens quickly allowing the correct supply of oil necessary for the pressure multiplication step.

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) injection return drain valve uncontrolled (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 10A:
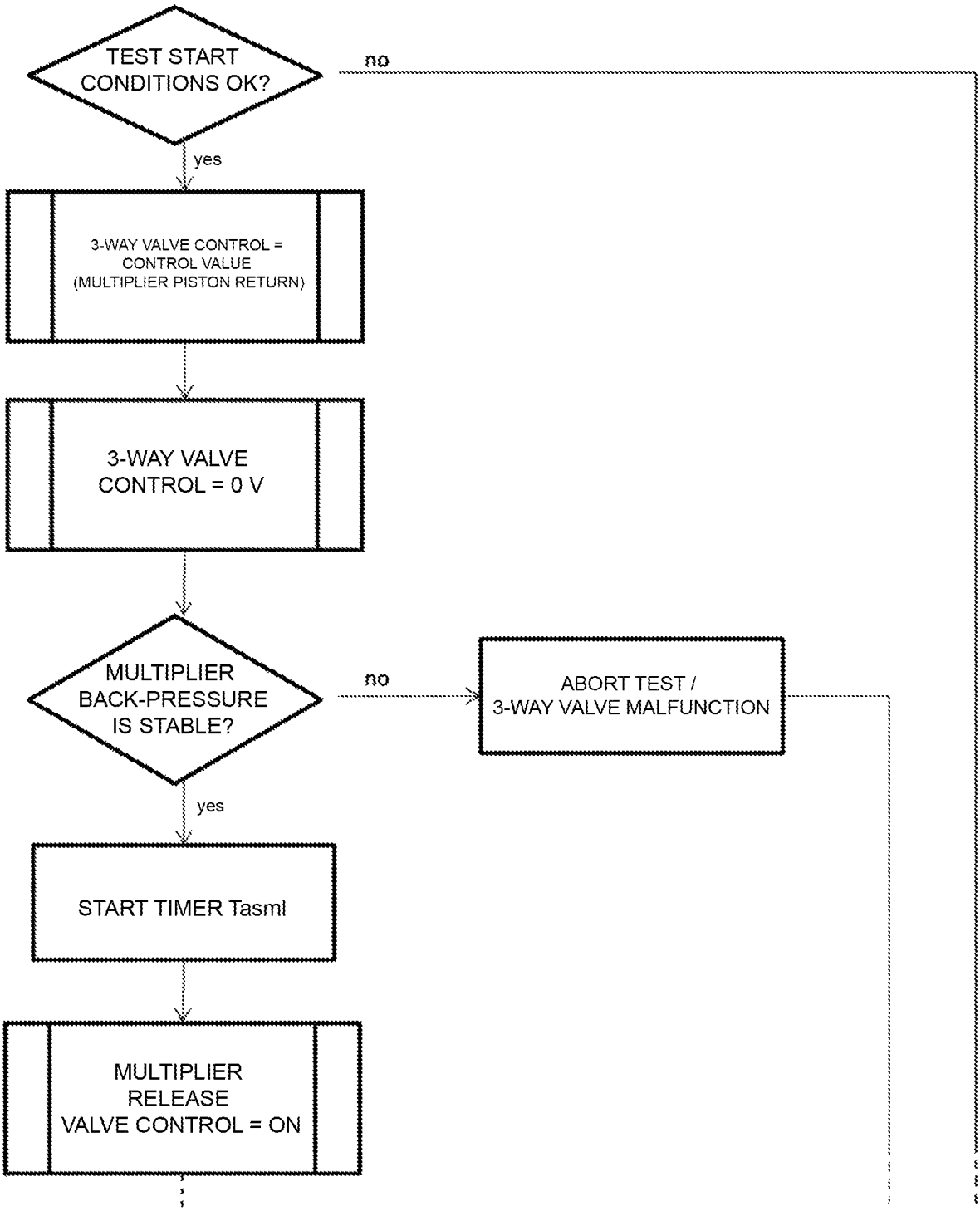
Figure 10B:
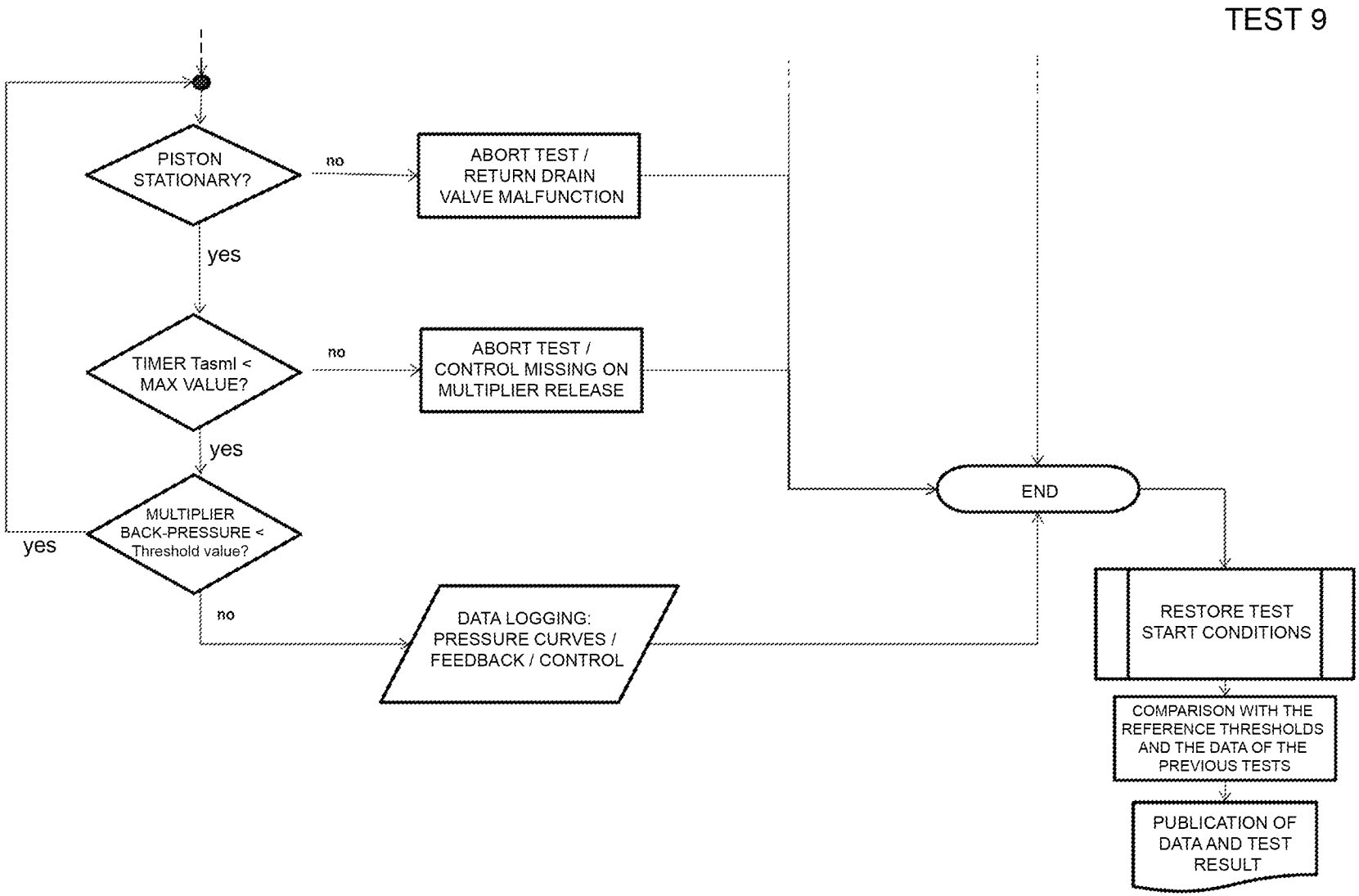

The test is performed according to the flowchart of FIG. 10, wherein
tasml=timer to verify the opening time of the multiplier release valve.

Test 10: Opening/Closing Time of the Main Multiplier Valve (Closed Loop Injections)

The purpose of the test is to verify the minimum opening and closing times of the 3-way multiplier valve (opening and closing speed).

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) uncontrolled injection return drain valve (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 11A:
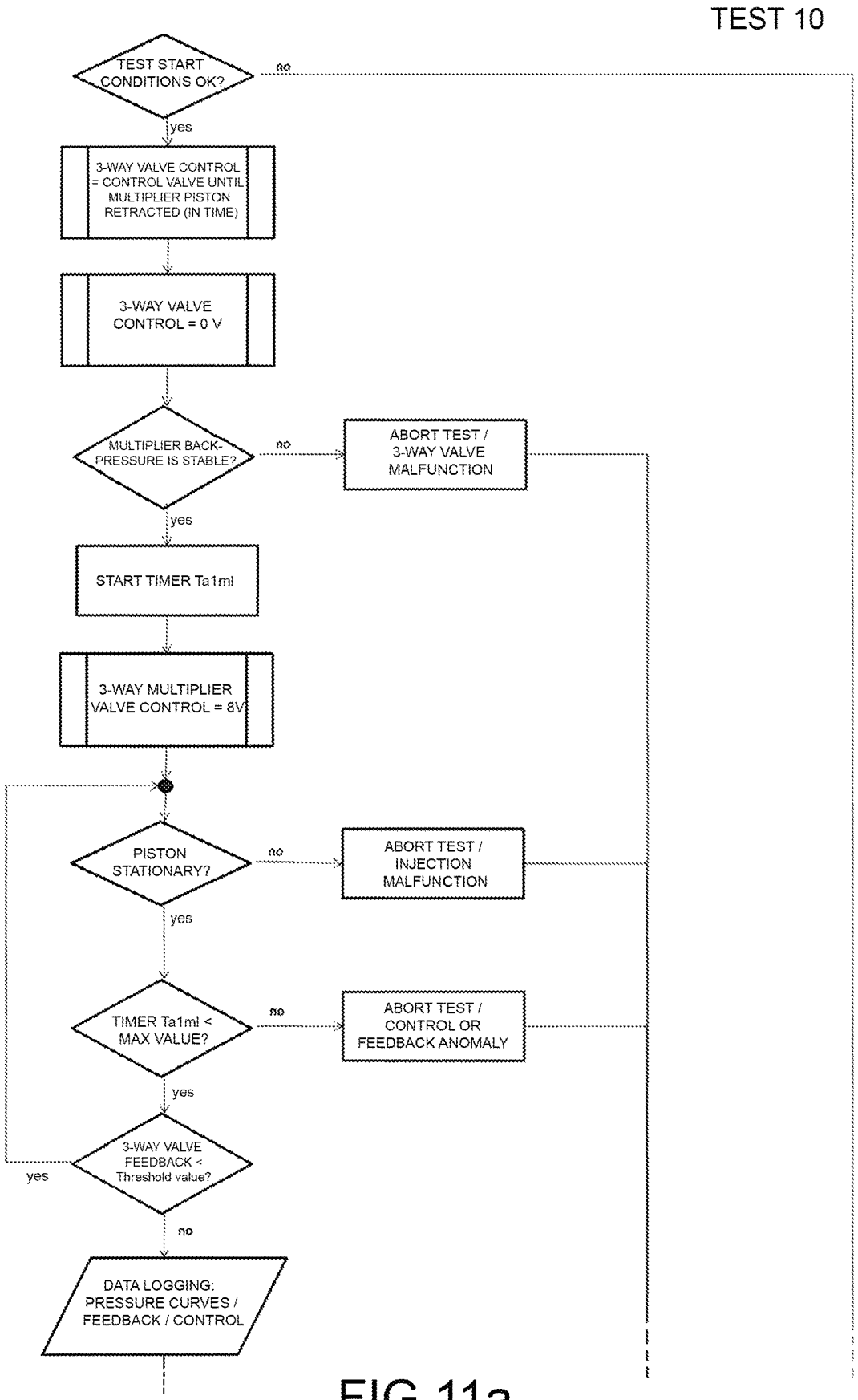
Figure 11B:
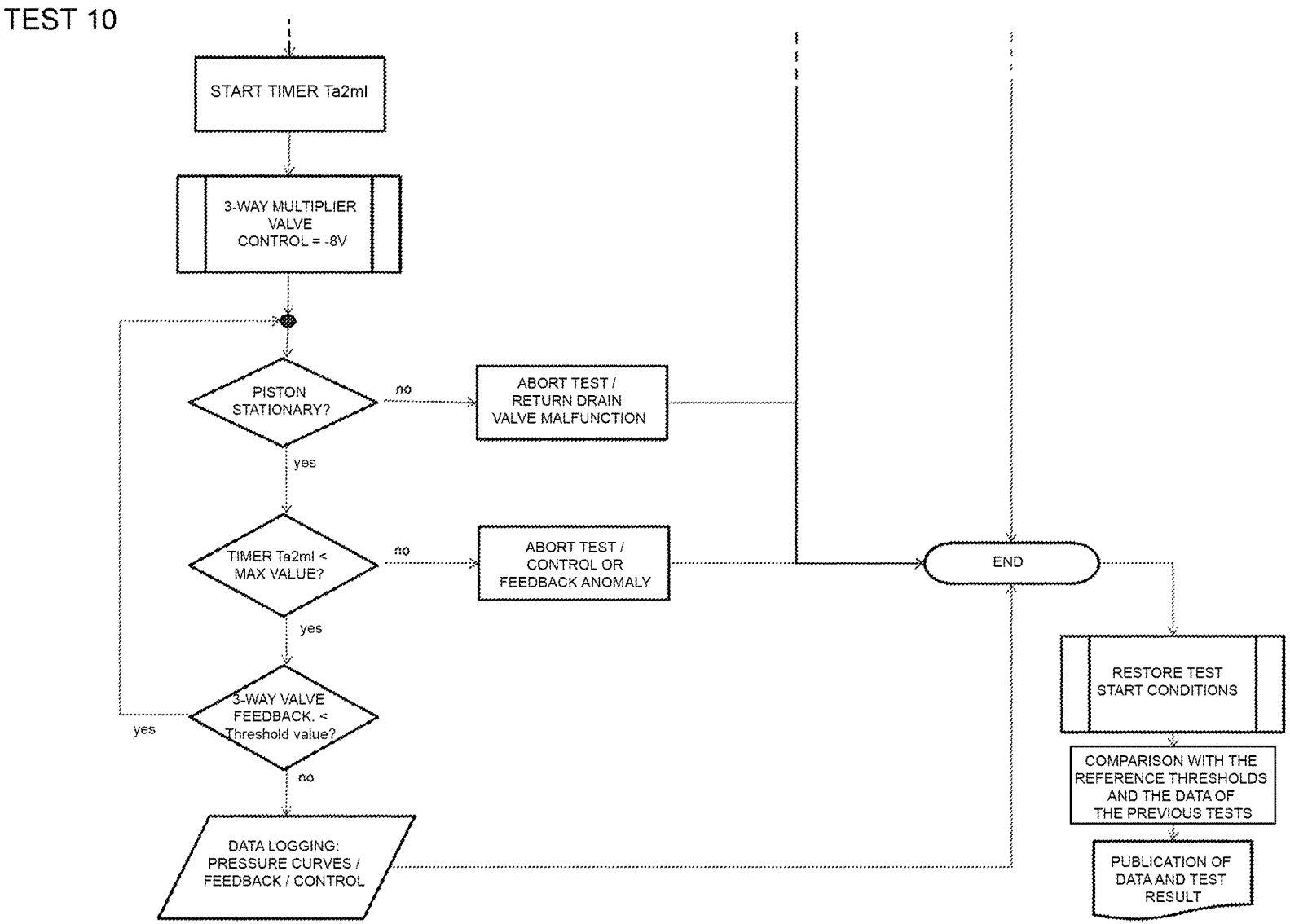

The test is performed according to the flowchart of FIG. 11, wherein
ta1ml=timer to verify the positive opening time of the main multiplier valve;
ta2ml=timer to verify the negative opening time of the main multiplier valve.

Test 11: Main Multiplier Valve Feedback

The purpose of the test is to verify the accuracy between control and feedback of the main multiplier valve and is available for valves with feedback measurement.

The test is performed with a stationary injection piston.

The test start conditions are as follows:
1) drain valve with enabling=on and control voltage=0 Volt;
2) feed valves with enabling=on and control voltage=0 Volt;
3) main multiplier valve with enabling=on and control voltage=0 Volt;
4) drain valve feedback<threshold value (indicating valve in closed condition—if signal is available);
5) feed valve feedback<threshold value (indicating valve in closed condition—if signal is available);
6) main multiplier valve feedback between threshold values (low-high, indicating valve in closed position);
7) multiplier release valve uncontrolled;
8) uncontrolled injection return drain valve (feed chamber drained);
9) injection return valve uncontrolled;
10) multiplier return drain valve off (head side chamber drained);
11) feed pressure<threshold value (indicating no pressure);
12) piston in the retracted position;
13) injection safety access ports closed.

Figure 12A:
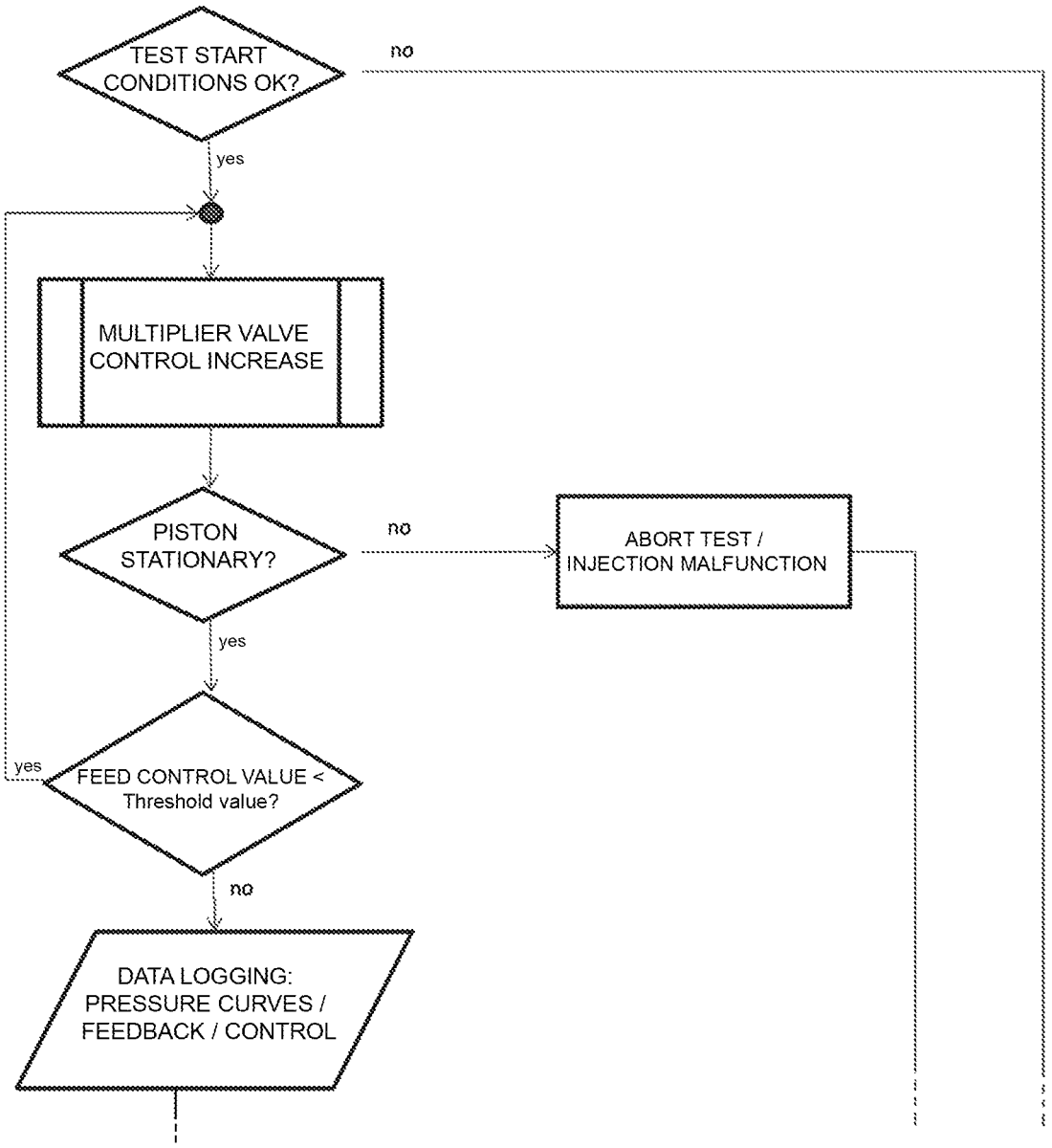
Figure 12B:
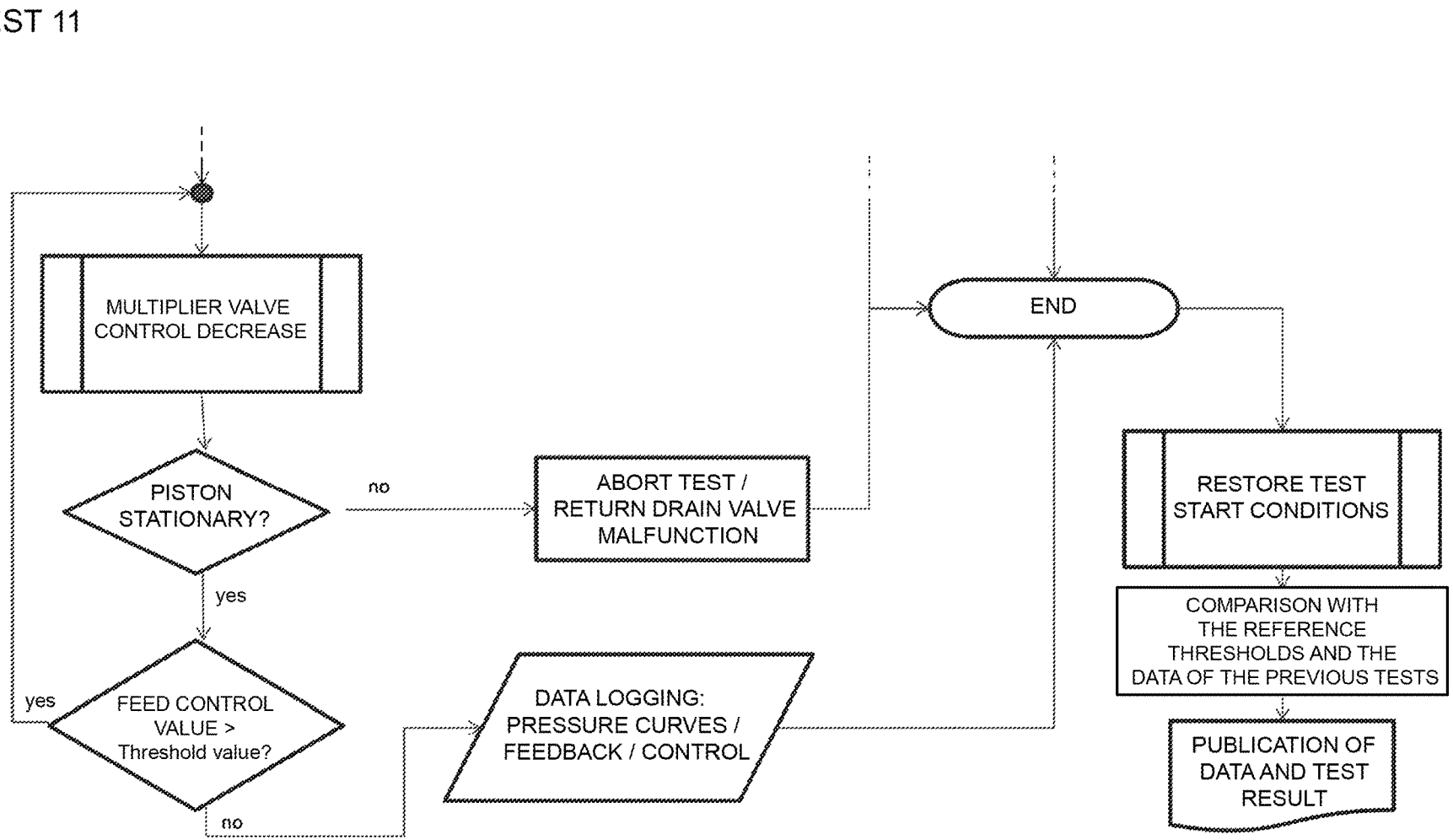

The test is performed according to the flowchart of FIG. 12.

The injection assembly according to the present invention overcomes the drawbacks referred to with reference to the prior art, since it allows one to check the proper operation of the valves, highlight malfunctions or verify performance over time.

It is clear that one skilled in the art, in order to meet contingent needs, may make changes to the injection assembly described above, all contained within the scope of protection defined by the following claims.

The invention claimed is:

1. Injection assembly of a die-casting machine, comprising-:

an injection piston controllable in translation to operate on cast molten metal in a mold of the die-casting machine, and a main pressure chamber for containing and pressurizing a fluid for translation of the injection piston;

a multiplier piston controlled hydraulically to increase a fluid pressure in the main pressure chamber;

a plurality of valves to manage an advance and a return of the injection piston and of the multiplier piston, wherein the plurality of valves comprises at least one of a proportional feed valve, an injection return drain valve, injection return valve, a proportional injection drain valve, a multiplier release valve, a multiplier return drain valve, or a proportional main multiplier valve;

at least one position transducer to provide electronic feedback of operation of the plurality of valves;

an electronic control operatively connected to the plurality of valves and to the at least one transducer to control the opening and closing of the valves, the electronic control comprising a test management program configured to perform a plurality of diagnostic tests on the plurality of valves, wherein the test management program is configured to perform a test for each valve, in sequence, and to compare parameters detected during the test with a predefined range or with a threshold value; and a display to display the result of the diagnostic tests.

2. The injection assembly of claim 1, wherein the test management program is configured to perform, in succession, all the tests of the plurality of diagnostic tests.

3. The injection assembly of claim 1, comprising:

an injection piston position sensor to detect a position of the injection piston;

a main back pressure chamber pressure transducer, to detect the pressure in a main back pressure chamber;

a main pressure chamber pressure transducer, to detect the pressure in the main pressure chamber;

a secondary back pressure chamber pressure transducer, to detect the pressure in a secondary back pressure chamber.

4. The injection assembly of claim 1, wherein the test management program provides for the performance of at least one of the following tests:

a feed valve offset value test, a drain valve offset value test, an opening and closing time of the feed valves test, an opening and closing time of the drain valve test, a feed valve feedback test, a drain valve feedback test, a feed valve hydraulic leakage test, a drain valve hydraulic leakage test, an opening and operation of the multiplier release valve test, an opening / closing time of the main multiplier valve test, or a main multiplier valve feedback test.

5. The injection assembly of claim 1, wherein the test management program provides for the exclusion of part of the hydraulic circuit from the fluid, so that there are the optimal conditions for the verification of the predefined valve on which the test is performed.

6. A method for diagnosing valves in a hydraulic circuit of a die-casting machine for light alloys, the method comprising:

performing a diagnostic test for each valve of a plurality of values, in sequence;

one at a time, comparing the parameters detected during the diagnostic test with a predefined range or with a threshold value to determine the result of the test; and the subsequent displaying the result of the diagnostic tests.

7. The method of claim 6, wherein the performing of the diagnostic test comprises performing at least one of the following tests:

a feed valve offset value test, a drain valve offset value test, an opening and closing time of the feed valves test, an opening and closing time of the drain valve test, a feed valve feedback test, a drain valve feedback test, a feed valve hydraulic leakage test, a drain valve hydraulic leakage test, an opening and operation of the multiplier release valve test, an opening / closing time of the main multiplier valve test, or a main multiplier valve feedback test.

8. The method of claim 6, wherein a preliminary step is provided to exclude part of the hydraulic circuit from a fluid, so that there are the optimal conditions for checking a predefined valve of the plurality of valves, on which the test is performed.

* * * * *